US007961095B2

(12) United States Patent
George et al.

(10) Patent No.: US 7,961,095 B2
(45) Date of Patent: Jun. 14, 2011

(54) METHOD AND APPARATUS FOR A COOPERATIVE ALARM NETWORK

(75) Inventors: Sam O. George, Aliso Viejo, CA (US); H. Bola George, Aliso Viejo, CA (US); Ayodele J. George, Toronto (CA)

(73) Assignee: Gridbyte, Inc., Aliso Viejo, CA (US)

( * ) Notice: Subject to any disclaimer, the term of this patent is extended or adjusted under 35 U.S.C. 154(b) by 380 days.

(21) Appl. No.: 12/346,996

(22) Filed: Dec. 31, 2008

(65) Prior Publication Data

US 2010/0164719 A1 Jul. 1, 2010

(51) Int. Cl.
*G08B 13/00* (2006.01)

(52) U.S. Cl. ..... 340/541; 340/539.1; 340/568.1; 340/573.4

(58) Field of Classification Search ..... 340/541, 340/539.1, 568.1, 425.5, 426.1, 686.1, 687, 340/525, 573.4, 546
See application file for complete search history.

(56) References Cited

U.S. PATENT DOCUMENTS

| | | | | |
|---|---|---|---|---|
| 5,049,867 | A * | 9/1991 | Stouffer | 340/426.17 |
| 5,210,521 | A * | 5/1993 | Hojell et al. | 340/436 |
| 5,235,320 | A * | 8/1993 | Romano | 340/539.11 |
| 5,463,595 | A * | 10/1995 | Rodhall et al. | 367/93 |
| 6,028,505 | A * | 2/2000 | Drori | 340/426.17 |
| 6,783,167 | B2 * | 8/2004 | Bingle et al. | 296/76 |
| 7,787,857 | B2 * | 8/2010 | Peterman | 455/404.1 |
| 7,808,371 | B2 * | 10/2010 | Blanchet et al. | 340/426.1 |

* cited by examiner

*Primary Examiner* — Daniel Previl
(74) *Attorney, Agent, or Firm* — The Marbury Law Group PLLC

(57) ABSTRACT

Devices and methods using wireless or wired network communications to form cooperative alarm networks centered on themselves. Intrusion detection alarms broadcast signals notifying other intrusion detection alarms of its status. When an alarm system experiences a security event, such as an attempted break-in, it notifies its network of its security event and other alarm systems within a cooperative network commence security measures, such as honking horns and flashing headlights. The cooperative response of the networked alarm systems increases decibel level and, in turn, the likelihood of a deterrent intervention, such as the perpetrator being apprehended, as well as increases the deterrence capability of the alarm systems.

25 Claims, 12 Drawing Sheets

METHOD AND APPARATUS FOR A COOPERATIVE ALARM NETWORK

FIELD OF THE INVENTION

The present invention relates generally to wireless and wired network communications, and more specifically to communications among intrusion alarm systems.

BACKGROUND

Intrusion alarm systems typically perform two main tasks: detecting intrusions and responding to intrusions. The task of detecting intrusions is usually performed by way of monitoring one or more sensors that measure one or more of the following: inertia, differential changes in equilibrium, changes in concentrations of harmful substances within some location, vibrations, electrical circuit activations (e.g., opening or closing of a switch), images (e.g., images processed from closed circuit TV), breaks in an optical path, illegal activity on a computer, or other mechanisms.

When responding to intrusions, intrusion alarm systems typically behave in one of three ways. Single-unit alarm systems typically activate individually ("go off"), such as sounding a siren, when disturbed. The main disadvantage of this type of alarm system is that a single alarm siren may not be loud enough to attract the attention of passersby and neighbors. In a second type of alarm system, alarm units alert a central security firm (e.g., Brink's® Home Systems). While surveillance systems that relay signals to a central office are widely deployed and effective in crime reduction, they suffer from the drawback of a lag time between notification and arrival of security agents at the crime scene. In addition, in the event of false alarms, the cost of sending security agents to check for crime is passed on to the end-user as higher service premiums. In a third type of alarm system, an automobile alarm provides a signal to enable security personnel to track and locate the automobile (e.g., LoJack®). Alarm systems equipped with devices for tracking stolen items may not be ideal for a number of reasons: First, they are only activated after theft has been reported to law enforcement authorities and tracking devices have been activated. Hence, they may not prevent or deter theft in the first place. Second, units can only be installed by professionally trained technicians. The infrastructure is complex—often requiring installation of specialized hardware on police cruisers, helicopters, buildings and towers. Such systems are expensive for both the individual and civic governments. Third, such systems only work if the stolen asset is close to a detection unit; the implication of LoJack's availability in 26 states means that the probability of recovering stolen items would be zero in states where the technology is not available. Even in areas where the LoJack technology is available, installation and retrofitting costs can limit its widespread adoption, especially in economically-distressed areas where crime may be highest.

SUMMARY

The various embodiments utilize wireless or wired networking communications to establish, maintain, and disband cooperative alarm networks to enable collective responses to security events. In an embodiment, alarm systems may transmit a first signal to form a cooperative alarm network by indicating that the alarm is active and not experiencing a security threat, transmit a second signal to indicate that the alarm system is undergoing a security threat, and transmit a third signal to indicate that the alarm system is deactivating.

The various communications may include a unique identifier corresponding to each activated alarm system. In an embodiment, network membership and size are based on proximity determined by measuring signal strength of received communications signals.

BRIEF DESCRIPTION OF THE DRAWINGS

The accompanying drawings, which are incorporated herein and constitute part of this specification, illustrate exemplary embodiments of the invention, and together with the general description given above and the detailed description given below, serve to explain the features of the invention.

DETAILED DESCRIPTION

Figure 1:
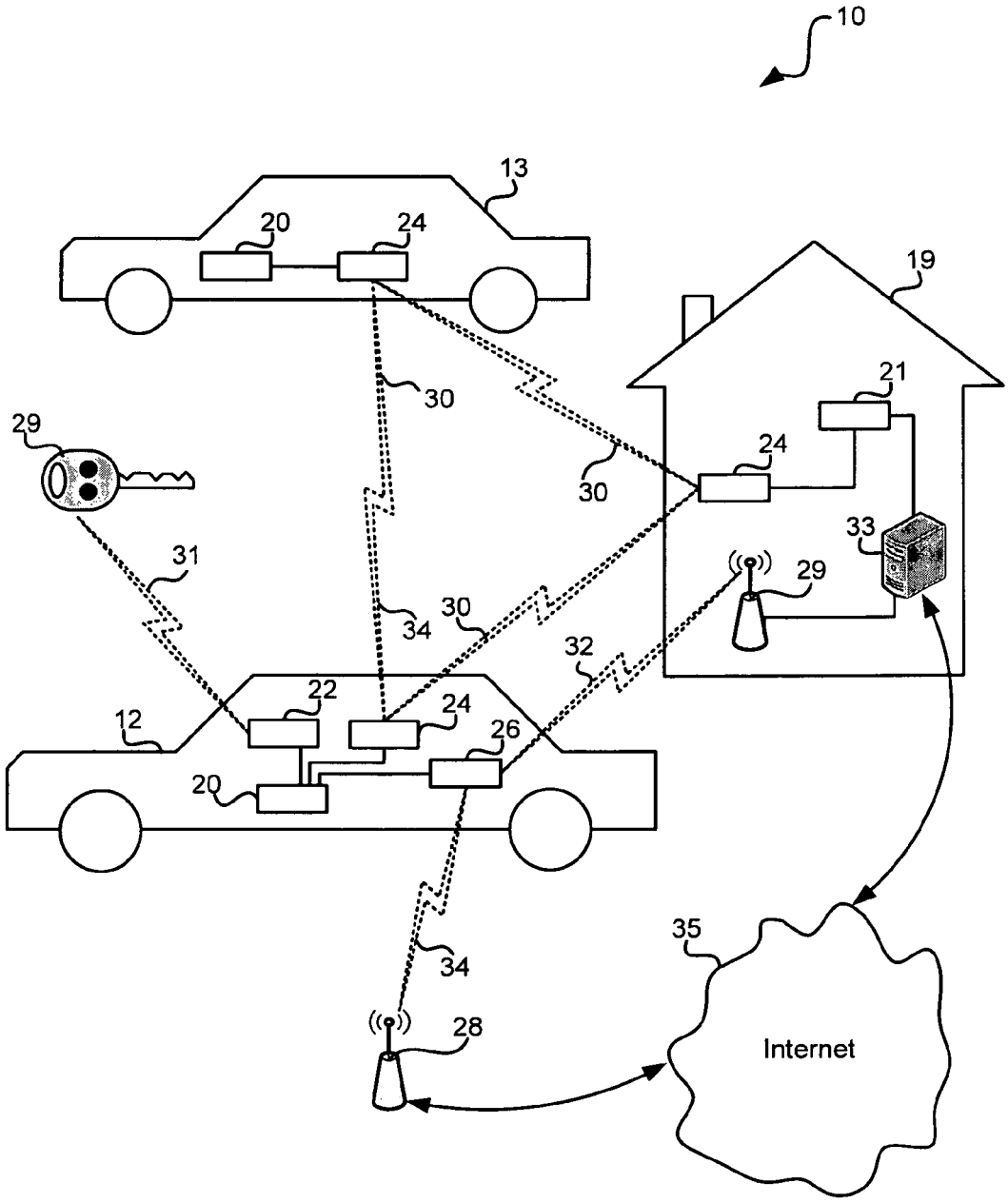
FIG. 1 is a system block diagram of a cooperative alarm network according to an embodiment.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the invention or the claims.

As used herein, the terms "alarm," "car alarm," and "house alarm" refer to electronic devices or systems meant to monitor one or more sensors and to respond to a signal from one or more sensors by generating an alarm or communicating with other units. Monitored sensors may include, but are not limited to, sensors that will detect events associated with unauthorized disturbance of an asset (e.g., an automobile) that the alarm is meant to protect. The nature of such disturbances can be physical (including theft, movement, shaking, or intrusion into the physical confines of the asset), biochemical (including detection of harmful substances intentionally or accidentally released within some confined space) and/or software-related (including illicit activity or detection of viruses on a computer within some network). While various embodiments are described with reference to a car alarm application, this is merely for simplicity of description, as the various embodiments may be implemented in houses, boats, public or laboratory spaces, computer systems and other types of assets. The acronym "CoAN" stands for cooperative alarm network. As used herein "cooperative alarm network system" or "CoAN system" refers to an alarm system according to one of the various embodiments.

As used herein the term "security event" refers to any event to which the alarm system was designed to monitor and respond, including but not limited to attempts to perpetrate a theft of or an intrusion into the physical confines of the protected object.

As used herein, the term "security measures" refers to any response the alarm system was designed to execute when the alarm detected a security event, such as activating an annunciator which may include but is not limited to an audible siren, the car's horns, flashing lights and combinations of these annunciators. As used herein, "annunciator" refers to any audible noise generator or visual display which can annunciate an alarm condition. In a typical implementation, an annunciator may be a siren coupled to the alarm system, possibly in combination with flashing headlights which together may comprise the security measures implemented in response to a security event and reception of a distress signal from other alarm systems.

The various embodiments provide methods for establishing a cooperative alarm network. Car alarm systems are common in many automobiles, but are typically limited to responding to security events by activating equipment contained in the car itself, such as honking horns and flashing headlights. A cooperative alarm network enables an alarm in one car (or house, boat, etc.) to notify neighboring alarm systems within a pre-defined area of the security event. Communication among assets within the perimeter constituting the distressed network ensures commencement of security measures, such as sounding of audible sirens, for increased theft deterrence. For example, if a would-be thief attempts to break into a first car equipped with a cooperative alarm system, all the cars in the surrounding area equipped with cooperative alarm systems may be notified of the security event so that they can each activate their audible sirens. The collective activation of numerous sirens may notify more people of the attempted theft, thereby increasing the probability that someone will respond to the security event. Ideally, the potential that a break-in could set off alarm sirens on dozens of vehicles would decrease chances for a successful robbery and may deter car thefts and break-ins. The same concepts apply to home alarms and boat alarms, among others.

The various embodiments may employ a variety of wired and wireless networks, including for example a network employing radio frequency (RF) communication links and wired communication links. By way of example, FIG. 1 shows a block diagram of a communication network 10 including cars 12, 13 and a house 19. Cars 12, 13 may be equipped with CoAN systems 20. Each CoAN system 20 may include or be coupled to a control transceiver 22 which receives signals from a key fob 29 via RF communications 31 to activate and deactivate the CoAN system 20. In an embodiment, the key fob 29 may also receive RF communication signals sent by the CoAN system 20 to notify the user of security events.

In order to establish a cooperative alarm network, a CoAN system 20 includes (or may be coupled to) a network transceiver 24. The network transceiver may be configured to send and receive signal "chirps" 30 to/from other network transceivers 24. Each CoAN system is configured to form a "routerless" autonomous network centered on itself. This protocol enables complete anonymity and allows cars to come and go without impacting other systems' operations since each CoAN does not rely on other alarm systems to accomplish its alarm functions. By way of contrast, if alarm system networks are not autonomous then there is a need for network controllers. In such a system, if a car leaves the network, there is a need to reestablish networks and reallocate network controller roles, effectively adding complexity to the system. The CoAN protocol offers peer-anonymity because, once established, all cars respond uniformly. This peer-anonymity makes it difficult to defeat the CoAN protocol by methods such as gaming, et al.

In a preferred embodiment, the CoAN system 24 uses an RF spread spectrum transceiver to communicate with nearby systems. In a further preferred embodiment transmit communications are accomplished via 2.4 GHz (or similar ISM band) spread-spectrum RF chirps transmitted at a constant power level of about 20 dBm. Spread spectrum network signaling improves tamper resistance since the networking signals cannot be easily jammed or otherwise interfered with. However, the invention is not limited to spread spectrum transceivers, and other types of transceivers may be employed without departing from the spirit of the claims (except claims specifically reciting a spread spectrum transceiver).

CoAN systems 20 may also be equipped with or coupled to wireless or wired network interface transceivers 26 (e.g., an IEEE 802.11 WiFi transceiver) for sending and receiving other types of network communications. A wireless network interface transceiver 26 may communicate with either a cell tower 28 via cellular telephone signals 34 or WiFi access point 29 in order to reach private networks or the Internet 35.

In addition to cars, houses 19 may also be equipped with CoAN systems 21. Such home cooperative intrusion alarm systems 21 may be equipped with a networking transponder 24 for sending and receiving network signaling chirps 30 in order to establish a cooperative alarm network. Intrusion alarm systems 21 may also connect to the Internet 35 via a network enabled device 33 located in the home 19 that has a connection to the Internet.

Figure 2:
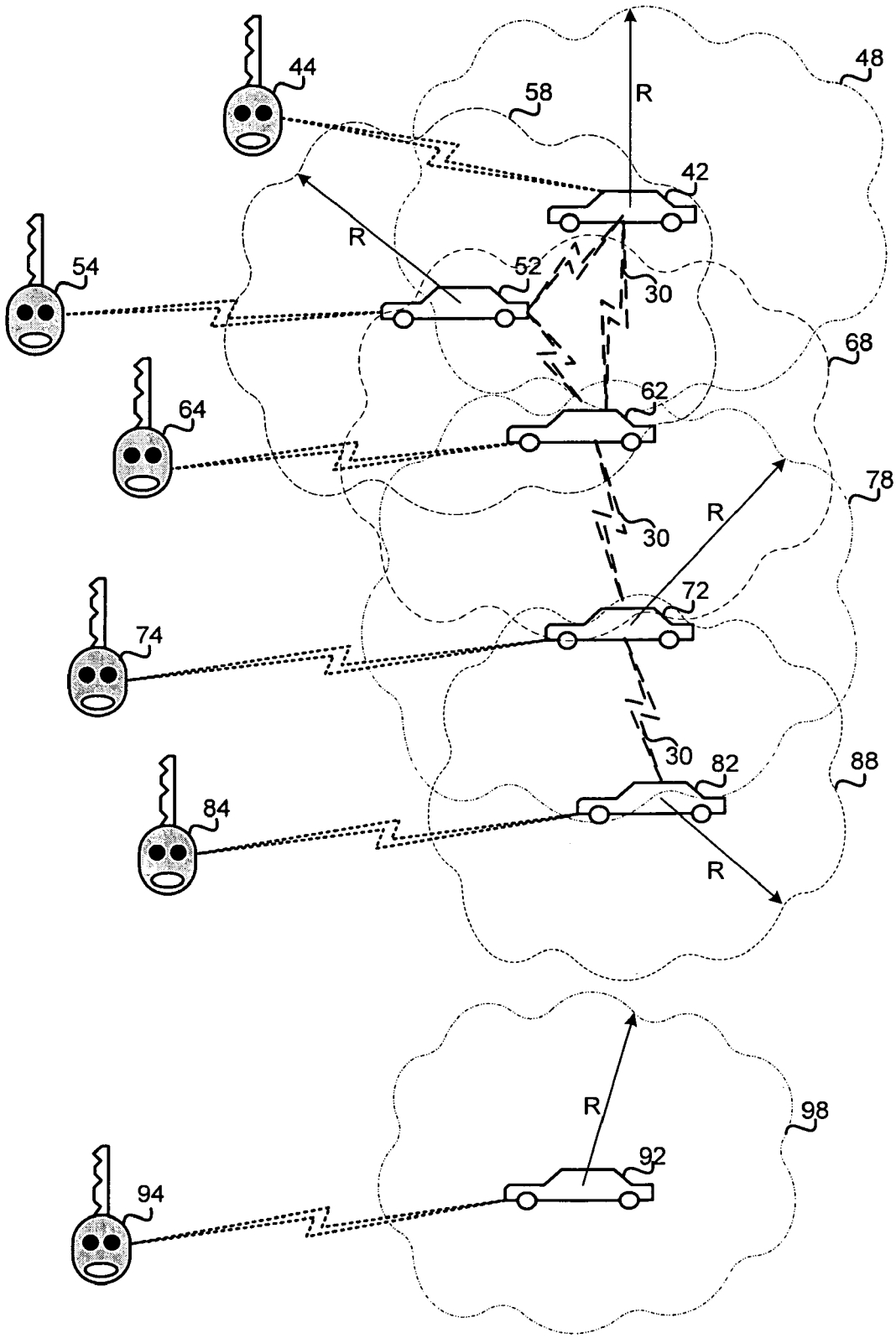
FIG. 2 is a system block diagram of a cooperative alarm network according to another embodiment.

As illustrated in FIG. 2, cars 42, 52, 62, 72, 82, 92 equipped with CoAN systems 20 can form cooperative alarm networks 48, 58, 68, 78, 88, 98, respectively. A car 52 equipped with a CoAN system 20, activated by a key fob 54, can send and receive network signaling chirps 30 to communicate with nearby cars 42 and 62. The resulting cooperative alarm network 58 is made up of cars 52, 42 and 62. Likewise, each of the nearby cars 42 and 62 sends and receives network signaling chirps 30 to communicate with nearby cars to form cooperative alarm networks 48, 68 centered on themselves. Thus, each CoAN system is simultaneously the center of its own cooperative alarm network and participating as a member of the cooperative alarm network of each CoAN system within range, R. Membership in a cooperative alarm network 48, 58, 68, 78, 88, 98 can be limited or defined by limiting the transmission power of the network signaling chirps 30, because limiting transmission power limits the effective radio frequency reception/detection range R. In a preferred embodiment transmission power is approximately 20 dBm which corresponds to a detection range of about 100 meters in all spatial directions around a car. Thus, all car alarms within the effective radio frequency reception range R will be included in the cooperative alarm network of the car at the center. As illustrated in FIG. 2 and described below, cooperative alarm networks 48, 58, 68, 78, 88, 98 may overlap when two or more cars are within range of each other. Overlapping of cooperative alarm networks does not extend the distress alarming range. For example, cooperative alarm networks 58 and 78 overlap. In this example, if there is an alarm event on car 52, cars 72 and 82 will not sound their alarms; however, cars 52, 42 and 62 will sound their alarms. Further, if there is an alarm event on car 72, cars 72, 62 and 82 sound their alarms; however, cars 42 and 52 will not sound their alarms. In short, cooperative alarm network overlapping is an artifact of detection range overlapping. This serves to include all possible assets in a cooperative alarm network while allowing those assets to participate in other cooperative alarm networks. Also, FIG. 2 illustrates how a car 92 located beyond the signal detection range R of any other car 42, 52, 62, 72, 82 will not be able to form a cooperative alarm network with any of the other cars shown. Nevertheless, car 92 will continue to periodically transmit network announce chirps 30 so that a cooperative alarm network can be established with a newly arriving car as soon as that car activates its CoAN system 20 within the detection range R.

Figure 4:
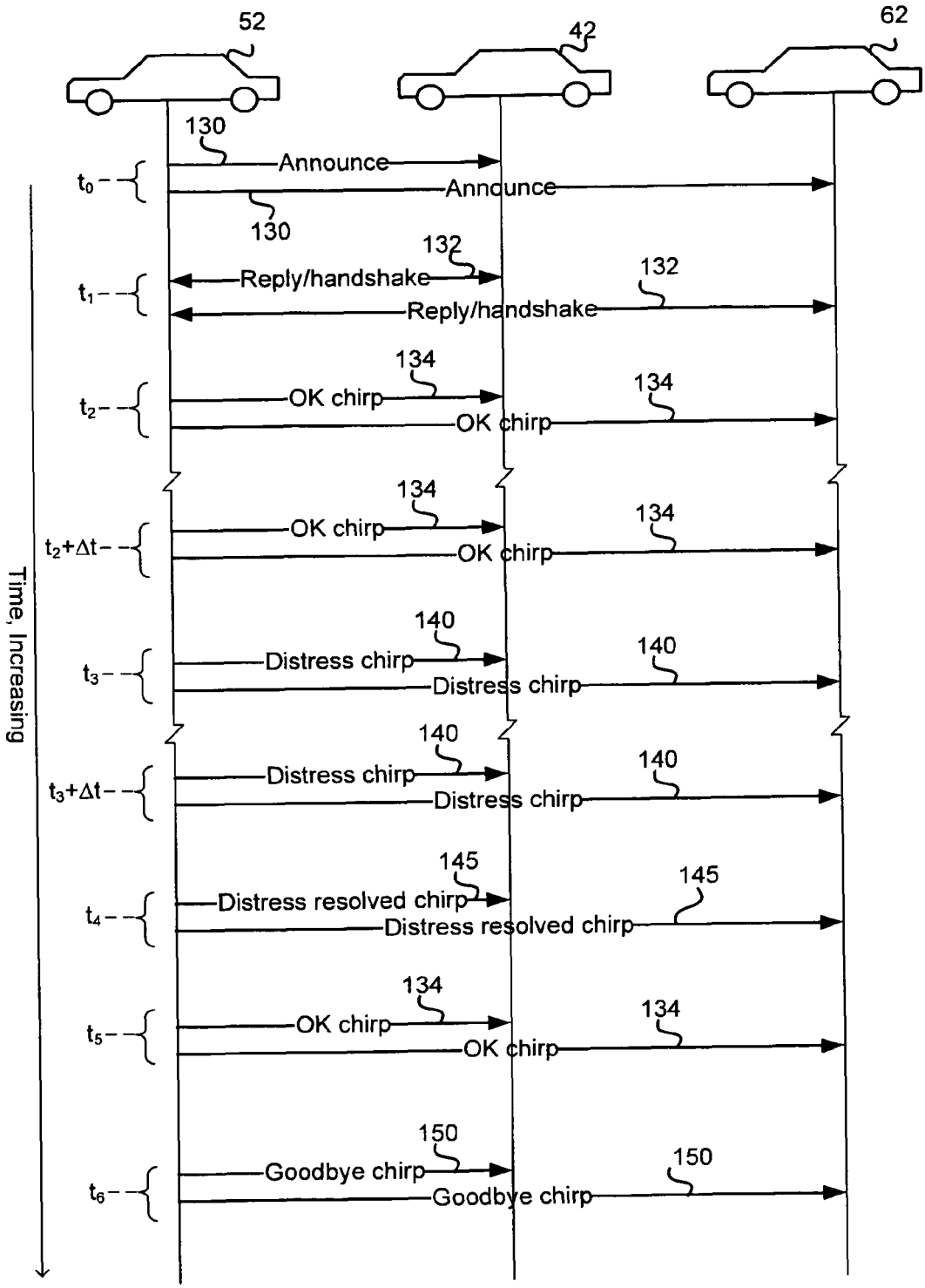
FIG. 4 is a message flow diagram of communications suitable for establishing a cooperative alarm network among cooperative alarm systems.

A CoAN system in car 52 maintains communication with other cars within its cooperative alarm networks by exchanging various chirp formulations according to a generalized chirp protocol sequence. A generalized chirp protocol sequence includes the basic set of chirp formulations shown in FIG. 4, such as Announce, Reply/Handshake, OK, Distress, Distress Resolved, and Goodbye. The generalized chirp protocol sequence is generally bounded by "Announce" and "Goodbye" chirps. FIG. 4 shows an example exchange of chirps between car 52 and neighboring cars.

Once each car 42, 52, 62, 72, 82 establishes a cooperative alarm network 48, 58, 68, 78, 88, the car's CoAN system 20 may periodically resend network establishment (Announce chirps) signals to add newly arriving cars to its cooperative alarm network, send status ("OK") messages, send security event signals ("Distress") if a security event occurs (as well as activating its siren), send a security event termination signal ("Distress Resolved") in response to a key fob command to terminate an alarm state, or send a network termination signal ("Goodbye") when the CoAN system is deactivated. These various signal formulations are described in more detail below with reference to FIG. 4.

In a second embodiment, a CoAN system 20 in car 52 may form an open cooperative alarm network. In this mode the CoAN system in car 52 does not receive returned signals from other nearby cars. However, these other cars can receive ("hear") the network announce chirps of car 52. Such a situation may happen if the transmission of other cars is interrupted (either because of insufficient signal strength or damage). For example, a car 52 with a CoAN system 20 may transmit network signaling chirps 30 which are received by nearby cars 42, 62 which do not respond. Similarly, each of the other cars 42, 62, 72, 82, 92 may transmit network signaling chirps 30 to establish their own cooperative alarm networks 48, 68, 78, 88, 98. Thus in this embodiment, car 52 is not responsively informed about nearby cars that may be in its cooperative alarm network but these non-responsive cars still participate in the at-large (open) cooperative alarm network of car 52. In this mode, the neighboring cars can amplify distress cries when car 52 broadcasts a security event.

In a preferred embodiment, each CoAN system 20 automatically replies to network establishment signals (e.g., network handshaking chirps 30) and thereby joins the cooperative alarm network of each CoAN system 20 from which it receives such signals. As such, automatic network joining is a fundamental part of the cooperative alarm network protocol that improves reliability and effectiveness of the alarm system. In normal operation, automatic network joining creates a secure communications channel between the central CoAN car and its CoAN members.

In a preferred embodiment, a CoAN system 20 may be configured to limit the number of other CoAN systems in its network. Each CoAN system is capable of discriminating more than 256 unique assets. This is because the CoAN chirps use a very short message length of 2,745 bits to formulate a small set of chirp formulations. For example, each CoAN system may limit membership in its cooperative alarm network to 128 closest assets (proximity subset) within its detection range, R. The membership ranking is based on proximity as determined by received signal strength of other CoAN transmitters and telemetry data. An advantage of CoAN systems is the decibel amplification that occurs from a very tight cluster of assets sounding their alarms in unison. Thus the CoAN protocol uses received power and signal transit time to ensure that the highest ranked assets used to define the members of a cooperative alarm network are indeed the "closest" assets. Received power is not the only consideration since two cars could be physically very close while RF power is low due to interference from a structural bulkhead. In this case transit time of signaling chirps allows the CoAN system to rank the neighboring asset higher than its received transmitter power would suggest.

In most circumstances the closest proximity subset of 128 assets exceeds the number of assets in the detection range of a CoAN system. However, this alternative embodiment may be useful if cars are parked in compact, multi-level parking garages wherein the number of assets within the CoAN detection range exceeds the maximum proximity threshold of 128. In this embodiment, the CoAN system discriminates and ranks up to 256 assets but only includes the closest proximity 128 assets within its cooperative alarm network based on received signal strength and telemetry data. In a similar embodiment, the process of comparing received signal strength to an adjustable threshold value may be employed to enable a CoAN system 20 to select a closest proximity subset of assets.

Figure 3:
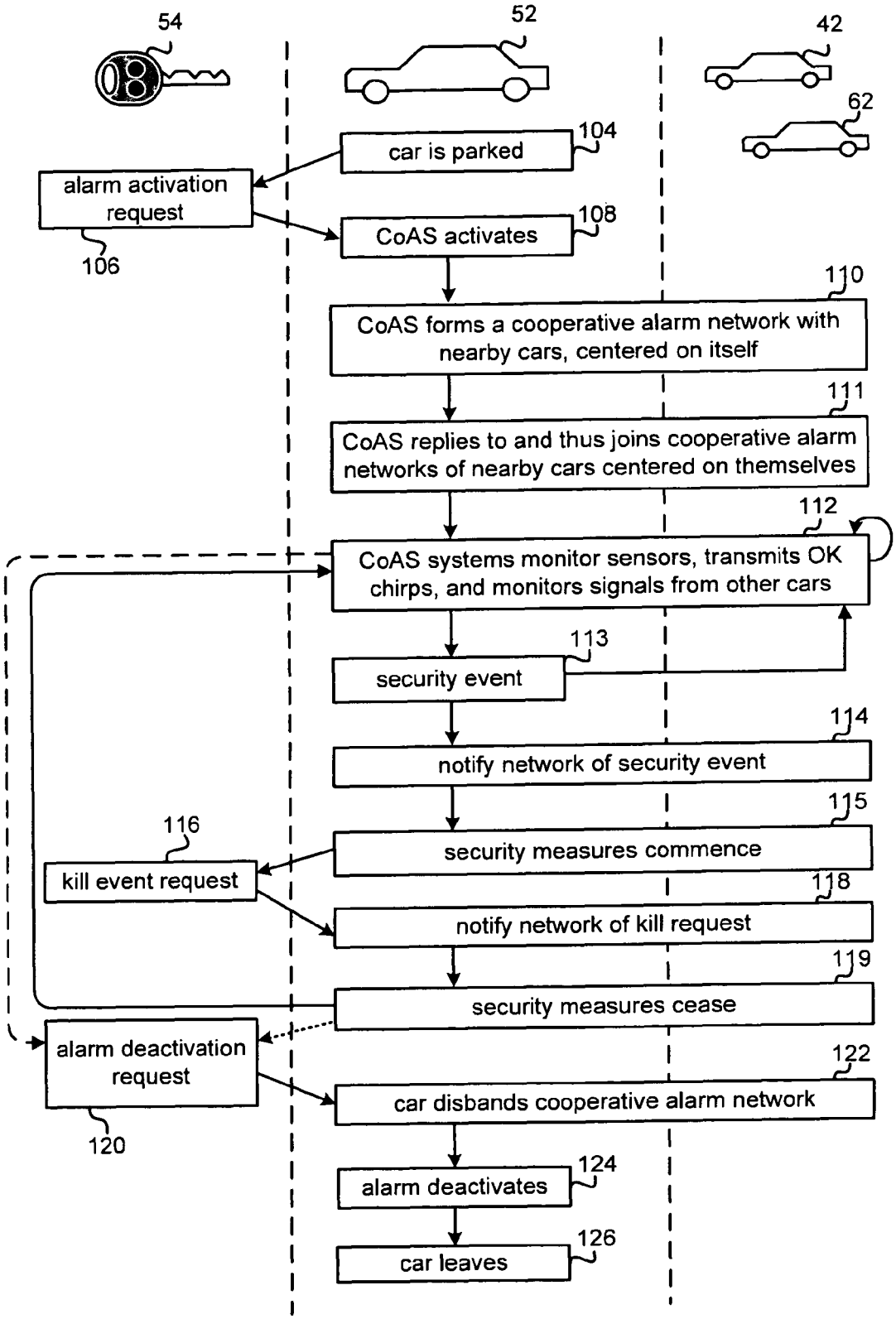
FIG. 3 is a process flow diagram of an embodiment method suitable for responding to a security event in a collaborative manner.

As previously mentioned, advantageously a cooperative alarm network can utilize the horns and sirens of alarm systems of all nearby CoAN system-equipped cars during a security event, thereby greatly amplifying the audible decibel noise level. FIG. 3 illustrates a simplified process flow diagram for how cars equipped with CoAN systems ("CoAS") can cooperate to execute alarm actions (e.g., activating audible sirens) simultaneously. A car 52 may create a cooperative alarm network when a user parks the car 52, step 104, and uses the key fob 54 to signal the CoAN system to activate, step 106. The CoAN system 20 in the car 52 receives the activation request and activates, step 108. The CoAN system 20 forms a cooperative alarm network with nearby cars 42 and 62 by transmitting network establishment signals (e.g., handshaking signaling chirps), step 110. The generalized CoAN protocol determines how CoAN assets communicate. In an alternative embodiment, other link establishment protocols may be used without loss of functionality. The nearby cars 42 and 62 cooperate in establishing encrypted network communication links such as by transmitting reply/handshaking chirps, thereby enabling the car 52 to establish its cooperative alarm network (part of step 110). Each link between all cars is securely encrypted as called for in the generalized CoAN protocol. The car 52 also cooperates in establishing network communication links with cars 42 and 62, thereby joining each of the cooperative alarm networks centered on each of those nearby cars, step 111. Once links are established, the car at the center of each cooperative alarm network broadcasts OK chirps to its network members in random round-robin order for added security. In case of an intrusion (e.g., security event, step 113), distress chirps are sent, step 114. In case of disband, goodbye chirps are sent, step 122.

The CoAN system 20 in car 52 continues to transmit network establishment signals even after a communication link has been established with another nearby car 42. For example, when car 62 drives up and parks, it will soon receive one of the periodically transmitted network establishment signals (e.g., an announce chirp) broadcasted by car 52. The CoAN system 20 in car 62 decodes the received signal, extracts the encoded identifier of the transmitting car 52, and sends its own signal back (e.g., a reply/handshaking chirp). As a result of the exchange of these network establishment signals, a communication link is established between cars 52 and 62. Once that link is established, there is an encryption channel between the CoAN systems in cars 52 and 62. Thereafter, the CoAN system 20 in car 52 will periodically transmit "OK" signals over the communication link to car 62; however, depending on channel characteristics, car 62 does not need to reply to those OK signals. This exchange of signals to establish a communication link is illustrated in FIG. 3 as step 110.

In a similar manner, car 42 is the center of its unique CoAN network. Thus, similar to the discussion above regarding car 52, car 42 forms communication links with cars 52 and 62. Thereafter, car 52 is member of car 42's cooperative alarm network as referenced in FIG. 3, step 111.

Once communication links have been established with nearby cars, the CoAN system in car 52 monitors sensors to detect a disturbance and/or intrusion, and periodically transmits OK chirps, step 112. In monitoring alarm disturbance and intrusion sensors, the CoAN system may receive electrical signals from position sensors (such as gyros) which are digitized and stored in memory. Based on stored numerical algorithms in the CoAN system processor (e.g., a DSP), states of the sensors when the system is first activated may be stored in memory corresponding to the car in an initial state of rest (i.e., undisturbed). These stored settings may be used as thresholds or baseline values which can be compared to electrical signals from the same sensors to detect when the car is being disturbed. As long as the alarm sensors indicate the car has not been disturbed, the CoAN system may continue to transmit OK chirps.

As a point of protocol, all newly arrived cars may first set up their own cooperative alarm networks in a manner similar to that described above with reference to car 52. After establishing its own cooperative alarm network, the arriving car then participates in other established cooperative alarm networks in a manner similar to that described above with reference to car 52.

When the CoAN system 20 in car 52 detects a security event (e.g., movement or intrusion), step 113, it can notify the other cars in its cooperative alarm network of the security event by transmitting a distress chirp over each of the established communication links, step 114. The distress chirp may be encrypted based on a maximum-strength cipher key. Upon receiving the distress chirp, the other cars 42, 62 within the cooperative alarm network of car 52 will activate their security measures, which may include audible alarms such as sirens or horns and visual signals such as flashing headlights, step 115. The owner of car 52 may be notified of the security event, such as by hearing or seeing the security measures implemented by the cars 52, 42, 62 in its cooperative alarm network. Also, the owner may be notified of the security event via a transmission from car 52 to fob 29 which may then emit a tone, vibrate and/or flash a light. The user may then use key fob 29 to send a kill event request signal to the CoAN in car 52, step 116. The CoAN system in the car 52 receives the kill event request signal and resumes broadcast of OK chirps to cars in its cooperative alarm network (42 and 62); step 118. As part of this step, the CoAN system may also transmit one or more Distress Resolved chirps. At this point all cars' security measures cease and the CoAN system returns to OK state, step 119, returning to step 112. The monitoring state may persist until the user deactivates the CoAN system in car 52, step 120. Once deactivated, car 52 sends a goodbye chirp to all the members of its CoAN, Step 122. Deactivation of car 52's cooperative alarm network has no impact on the cooperative alarm networks maintained by the remaining cars 42 and 62. At this point, the CoAN systems in the remaining cars 42 and 62 update their networks to take into account the departure of car 52.

FIG. 4 illustrates messages that may be transmitted between CoAN systems in various cars 52, 42, 62 according to an embodiment. This figure illustrates the formation of a cooperative alarm network from the perspective of car 52. Similar messages will be transmitted by/to each of the other cars 42, 62 as they establish their own cooperative alarm networks. When the CoAN system 20 in the car 52 is activated, the system broadcasts network establishment signals such as an announce chirp 130. These network establishment signals may include a unique identifier (ID) of the car's CoAN system so that systems receiving the signals can identify it as a distinctive source. In an embodiment, this CoAN system ID is generated each time the system is activated using random data (e.g., random data from an alarm sensor), a unique serial number assigned to the CoAN system, et cetera. Generating a unique ID each time the CoAN system is activated helps to defeat efforts to jam or compromise the system. The network establishment signals 130 are received by each of the nearby cars 42, 62, and in response, each transmits cooperative network establishment signals, such as reply/handshaking chirps 132. The reply/handshaking chirps 132 may include a unique ID for each of the cars' CoAN systems. As with the ID for car 52, the IDs included in the reply/handshaking chirps 132 may be uniquely generated when the CoAN systems in cars 42, 62 were initialized. As a result of the exchange of the network establishment signals between the car 52 and the nearby cars 42, 62, the CoAN system in car 52 establishes communication links to the CoAN systems in each of those cars. In an embodiment, the ID is a 512 bit value that can be used to encrypt messages transmitted via the established communication links.

With communication links established between the car 52 and each of the nearby cars 42, 62, the CoAN system in car 52 periodically transmits status signals, such as OK chirps 134, to each of the other cars 42, 62. The OK chirps 134 let those cars 42, 62 know that the transmitting car is in a non-alarmed status (i.e., not experiencing a security event). In an embodiment, the status signals may include the car's CoAN system ID so that the receiving cars can recognize the source of the OK chirps 134. In another embodiment, the transmitting CoAN system ID may be used as an encryption key-seed to generate a public/private key pair. The public keys are exchanged with the receiving cars 42 and 62 during handshaking. The CoAN messages to car 52 are encrypted with car 52's public key. Similarly, the messages emanating from car 52 are encrypted with the receiving car's public key.

When the CoAN system in car 52 detects a disturbance or intrusion indicating a security event, the system transmits a distress signal, such as a distress chirp 140, to each car in its cooperative alarm network via the established communication links. As with status signals, the distress chirp 140 may include the transmitting system's ID, use the ID as an encryption key, or otherwise identify the source of the distress chirp 140. Distress chirps 140 may be periodically transmitted by the CoAN system in car 52 until the owner of the car signals the CoAN system to deactivate the alarm conditions, such as by pressing a button on the system's key fob as discussed above with reference to FIGS. 2 and 3. When the alarm condition is deactivated, the CoAN system transmits an alarm termination message, such as a distress resolution chirp 145 to each of the cars 42, 62 in its cooperative alarm network via the established communication links. The distress resolution chirp 145 informs the receiving CoAN systems that they should cease security measures.

In addition to the messages described above, the CoAN system may also transmit a network disband message, such as a goodbye chirp 150, via the established communication links when the CoAN system is deactivated, such as when the user starts car 52. Sending a network termination message can inform the CoAN systems in the cooperative alarm network that the CoAN system is being properly deactivated versus being removed (as might be the case if the car 52 were stolen). In an embodiment, CoAN systems may be configured to activate security measures if a CoAN system ceases to transmit status signals (e.g., OK or distress chirps 134, 140) without first transmitting a network disband message. In an embodiment, the CoAN system may also transmit a goodbye chirp 150 via the established communication links to each of the CoAN systems whose cooperative alarm networks it has joined to inform them that it is leaving their networks.

The CoAN system embodiments are not limited to the five types of signals described above because the data content of each type of chirp is very small (e.g., 2,745 bits) and repetitive, allowing the system to support hundreds of different chirp formulations. Thus, additional types of network signals may be implemented in cooperative alarm networks without departing from the spirit of the present invention and the claims.

As mentioned above, in an alternative embodiment the cooperative alarm network may be formed by each CoAN system 20 transmitting signals without requiring receiving CoAN systems to return network establishment signals (e.g., announce chirps). In this embodiment, a car 52 will not receive any reply chirps. This condition may arise when the transmission from nearby cars in its detection radius, R, are impaired or blocked. The other cars may indeed receive announce chirps from car 52. These cars can respond to distress chirp in this "open" cooperative alarm network configuration. Such an embodiment may be particularly beneficial in situations where cars are positioned on the boundary of the detection range where their receiving CoAN systems may be able to receive announce and distress chirps but their network establishment transmit signals may not be received by the CoAN owner.

Figure 5A:
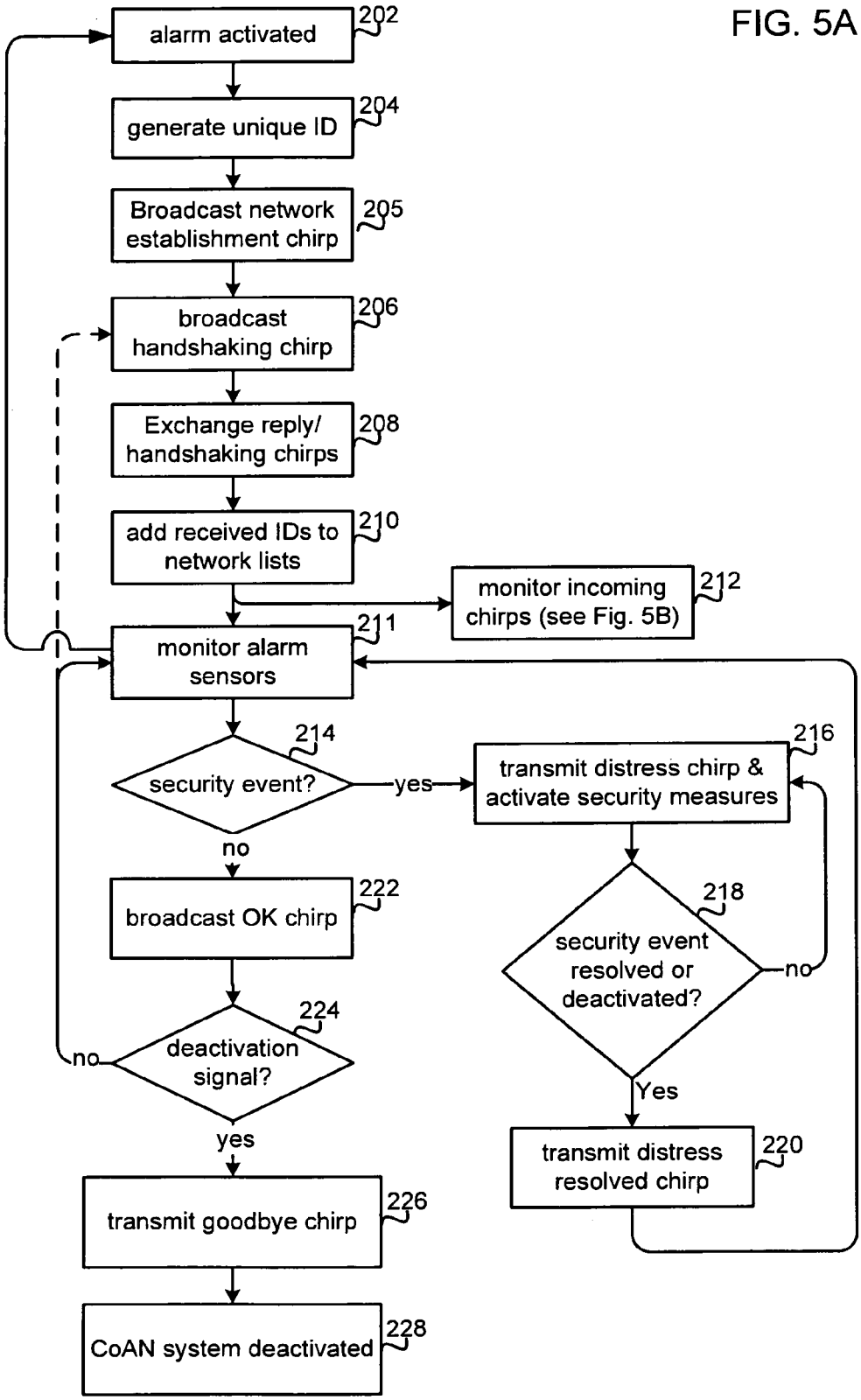
FIGS. 5A-5C are process flow diagrams of an embodiment method suitable for tracking and responding to network communications.

FIG. 5A is a process flow diagram of an embodiment method that may be implemented within a CoAN system to establish a cooperative alarm network and transmit appropriate status messages. When a CoAN system is activated, step 202, such as when a car is parked, the CoAN system may generate a unique ID that is valid until the car is restarted. As mentioned above, the unique ID may be generated in a manner that ensures the ID is both unique and random. This process of generating new unique IDs effectively ensures that all cars remain completely anonymous because their IDs are only valid until the next startup. For example, in an embodiment, a sensor value that is likely to be random, such as a set of gyro states when initially parked, is used as a random seed value that is combined with a globally unique serial number assigned to the CoAN system by the original equipment manufacturer (OEM) in an algorithm designed to produce unpredictable and unique IDs. In a preferred embodiment, a unique number associated with each CoAN system is 512 bits in length. Using such a number in combination with random sensor data, over one hundred trillion unique IDs can be generated as communication channels are established with other CoAN systems in nearby cars. Other methods for generating a session and system unique ID may be used. This unique ID then may be used by the CoAN system to label, encrypt or otherwise uniquely identify transmissions as originating from the CoAN system. In theory, the possibility that two automobiles will have the same exact inertial state of the sensor gyros (i.e., sensor data used for generating an ID) is practically zero. The use of sensor data with a maximum length encryption key seeded with internal factors vastly reduces the probability of two vehicles having the same keys. Additionally, networking signals are transmitted at 20 dBm which effectively limits the detection range to about 100 meters. The combination of low-power transmission coupled with the massive modulation encryption space reduces the likelihood of any two vehicles within detection range of each other having the same ID to less than $10^{-15}$.

The CoAN system may then broadcast a network establishment signal (e.g., an announce chirp), step 206. This network establishment signal may include the system's unique ID. Those CoAN systems receiving the network establishment signal transmit cooperative network establishment signals, such as a reply/handshaking chirp, which the CoAN system receives, step 208. The network establishment chirps sent by the CoAN system and those in nearby cars may be implemented in different ways according to the generalized CoAN protocol. Further, multiple rounds of network establishment signals may be exchanged between CoAN systems to negotiate communication link parameters. By exchanging the network establishment signals, steps 206, 208, the CoAN system establishes a communication link with each responding CoAN system. When the communication links are established the CoAN system may store the IDs of each of the networked CoAN systems in memory, such as in a network list, step 210. This list may be used by the CoAN system in transmitting signals to each other CoAN system in its cooperative alarm network. The list may also be useful in recognizing when a CoAN system withdraws from the network, such as by transmitting a goodbye signal 150.

At this point, the CoAN system has established a cooperative alarm network and the system continues monitoring of its alarm sensors and begins transmission of OK chirps, Step 211. Additionally, the CoAN system may monitor incoming signals transmitted by other nearby CoAN systems, step 212. The processing of received incoming signals, which will occur in parallel with the processing illustrated in FIG. 5A, is described below with reference to FIG. 5B.

The CoAN system may test the alarm sensor outputs to determine if an alarm condition exists, determination 214. The monitoring of alarm sensors to determine if an alarm condition exists may use a variety of methods known in conventional car alarm and other alarm technologies. For example, the CoAN system may compare an output value from a sensor (e.g., a gyro) to a threshold value that was recorded when the car's CoAN system was activated. If the CoAN system determines that a security event exists (i.e., determination 214="yes"), the system may transmit a distress chirp to each CoAN system in its cooperative alarm network, step 216. Once a security event has been determined, the CoAN system may continue to periodically transmit distress chirps, repeating step 216, until the system determines that the security event has been resolved or the system receives an alarm kill signal from the system's key fob, determination 218. When the system determines that the security event has been resolved or the system receives an alarm kill signal from the system's key fob (i.e., determination 218="Yes"), the system may transmit a signal indicating that the security event is ended, such as a distress resolved chirp, step 220. At that point the CoAN system may return to monitoring alarm sensors, returning to step 211.

If the CoAN system determines that the monitored alarm sensors do not indicate that an alarm condition exists (i.e., determination 214="no"), the CoAN system may transmit an appropriate status message, such as an OK chirp, step 222. The CoAN system may also determine whether a system deactivation signal has been received, such as when the car is started or the CoAN system otherwise is deactivated. If the system is not deactivated (i.e., determination 224="no"), the system continues monitoring alarm sensors, step 211. Periodically, the CoAN system also broadcasts network establishment signals, returning to step 206. When the system is deactivated (i.e., determination 224="yes"), the system may broadcast a network termination signal, such as a goodbye chirp, to each CoAN system within its cooperative alarm network, step 226, and then deactivate, step 228.

Figure 5B:
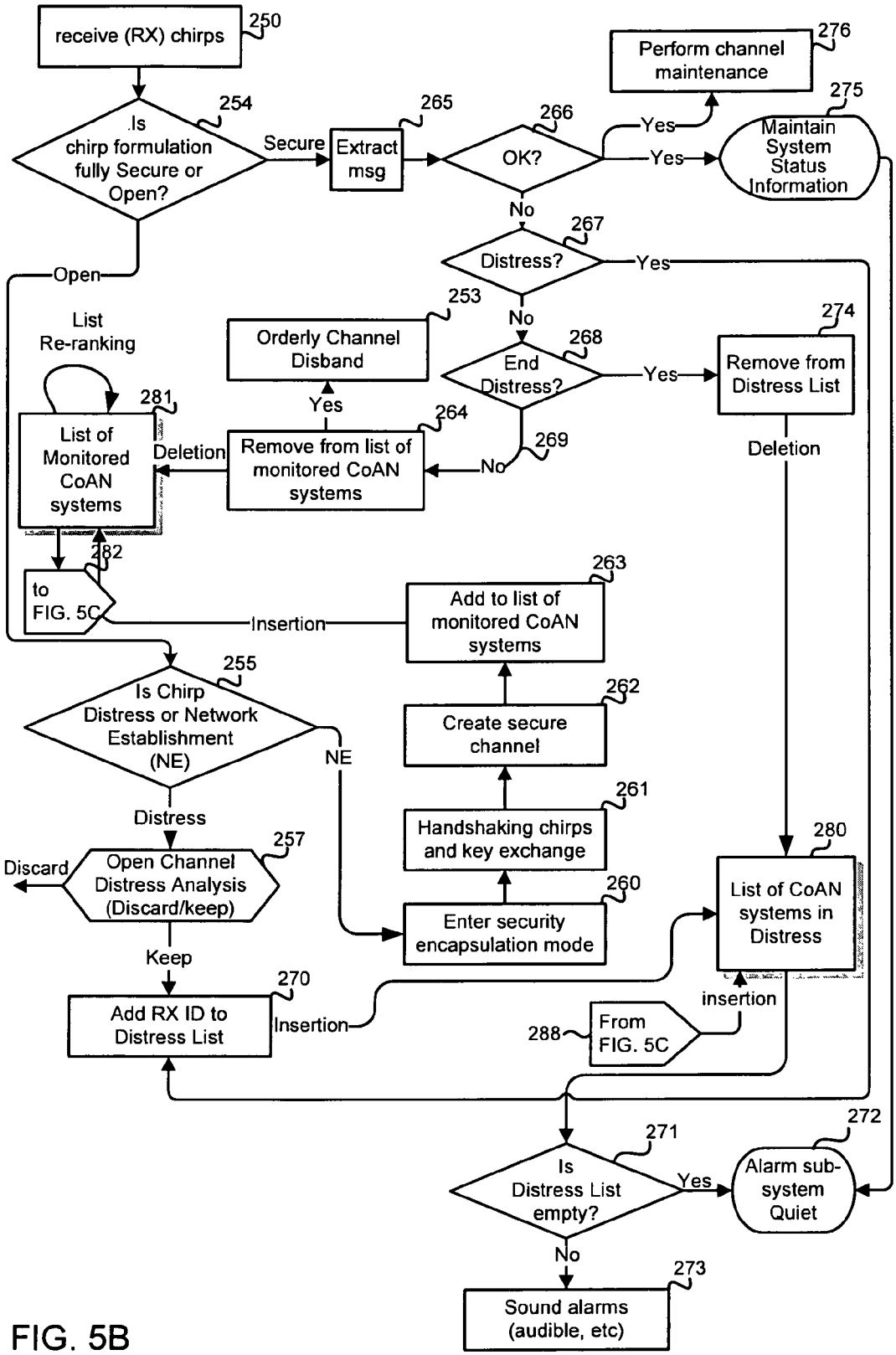

In addition to monitoring alarm sensors and transmitting status signals as described above, the CoAN system also monitors and responds to signals from all nearby CoAN systems. An embodiment method for monitoring and responding to each CoAN signals is illustrated in FIG. 5B. When the CoAN receives each (RX) chirp, step 250, the CoAN system checks the attributes of the message formulation to determine whether the message belongs to one of its fully secured messaging channels or whether the chirp belongs to an open messaging channel, determination 254. As described earlier, an open messaging channel is one that is partly secured and has not been authenticated and secured by the receiving CoAN system. However, such a channel receives messages formulated according to the CoAN protocol.

If the received chirp is from a secure channel (i.e., determination 254="Secure"), the messages in the secure chirps are extracted for processing, step 265. This processing may involve determining the type of message, determinations 266, 267, 268. If the message is "OK" (i.e., determination 266="Yes"), the CoAN system performs two functions. The CoAN system examines the message to determine channel parameters and use the channel parameters to optimize the communications link, step 276. OK messages are also recorded as system status messages, step 275, and, when received, used to keep the alarm sub-system in quiet mode, step 272. If the message is "distress" (i.e., determination 267="Yes") the CoAN system adds the received ID to the Distress list, step 270. This action inserts the RX ID into the Distress list, step 280. The Distress list is constantly monitored to determine if the list is empty, determination 271. As long as there are entries in the Distress list (i.e., determination 271="No"), the CoAN system will continue to sound its alarm, step 273. If the message is "end distress" (i.e., determination 268="Yes"), the CoAN system removes the RX ID from the Distress list, step 274. If the message is not any of an "OK," "distress," or "end distress" chirp (i.e., each of determinations 266, 267 and 268="No") then the received chirp must be a "Goodbye" chirp (see path 269) so the system removes the RX ID from the list of monitored CoAN systems, step 264, which is re-ranked, step 281. This action results in an orderly network disband, step 253. One of skill in the art would appreciate that the manner for determining the nature of the received chirps illustrated in FIG. 5B is for illustration purposes only, and that order in which chirps are evaluated may vary, and chirps may be evaluated in another manner, such as in a single step, such as a pattern matching or look up step (not shown).

Figure 5C:
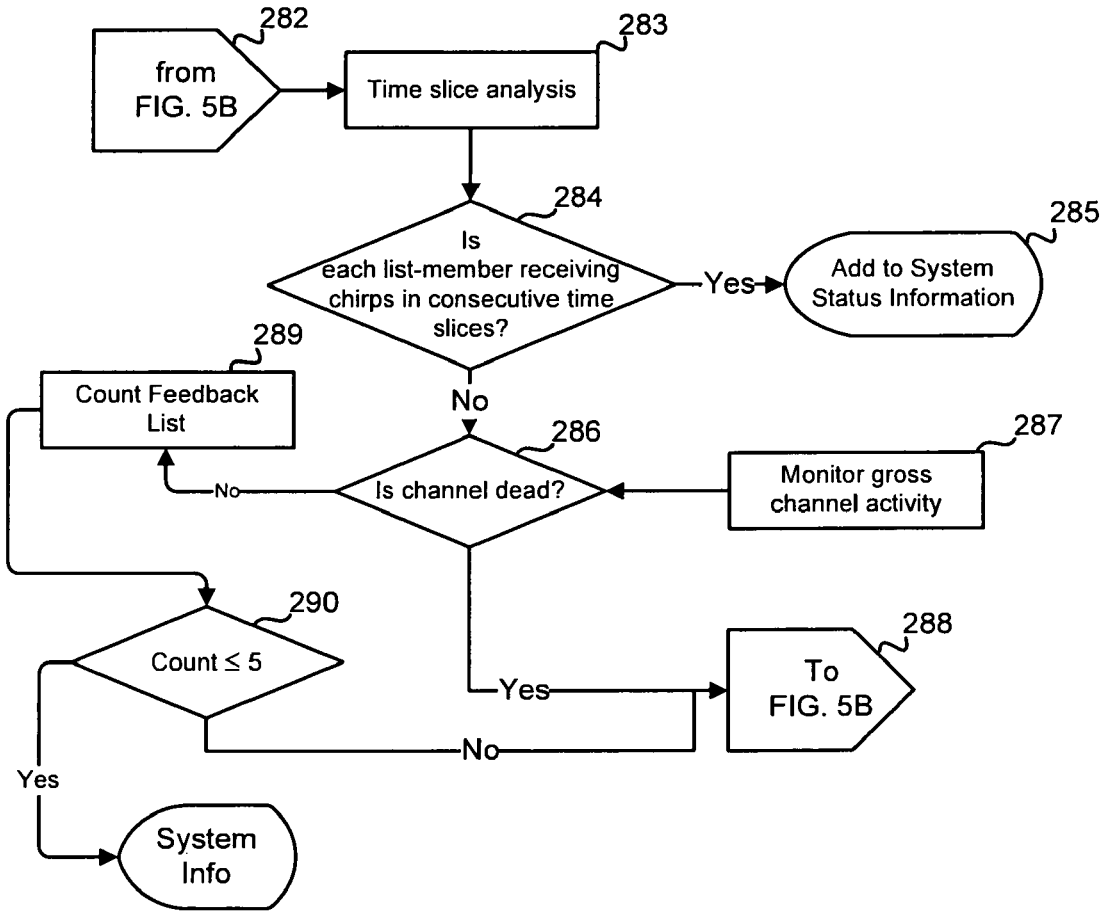

The list of monitored RX IDs is constantly re-ranked as various cars come and go, step 281. As part of monitoring the list of monitored CoAN systems, the CoAN system ensures that received RX IDs are present in contiguous time-slices (FIG. 1B—step 282 to FIG. 5C—step 283). FIG. 5C illustrates processes for performing a number of list supervisory functions. First, the CoAN system may constantly monitor the channel for chirp activity, step 287. Second, as part of time-slice analysis, step 283, the CoAN system verifies that list members are receiving contiguous chirps, determination 284. If so, the system maintains a non-action status, step 285. If continuous chirps are not being received from list members (i.e., determination 284="No"), the CoAN system determines whether the specific channel is dead, determination 286; i.e., whether there is no chirping activity. If the channel is not dead (i.e., determination 286="No), the CoAN system counts the number of contiguous "dead" channel time-slices, step 289, and determines if the number exceeds some threshold, count (e.g., 5), determination 290. If the maximum count is exceeded (i.e., determination 290="No"), the RX ID is inserted into the Distress list (FIG. 5C—step 288 to FIG. 5B—step 280).

Returning to FIG. 5B, if the RX chirp formulation is open (partly secured) (i.e., determination 254="Open"), the system further determines whether the message is a Distress or Network Establishment (NE) chirp, determination 255. If the chirp is a NE message (i.e., determination 255="NE"), the two CoAN systems enter into a security encapsulation mode, step 260. The two CoAN systems exchange handshaking chirps including security keys, system IDs, proximity, channel/link status and other information in the CoAN communication protocol, step 261. At the end of the handshaking process, the two systems formulate the parameters for their unique secure channel, step 262, and the transmitting CoAN system ID is added to the list of monitored CoAN systems, step 263. The list of monitored CoAN systems is constantly re-ranked to reflect proximity data based on signal power and other telemetry data, step 281.

If the received (RX) chirp is open (i.e., determination 254="Open") and contains a distress message (i.e., determination 255="Distress"), the system ID within the chirp may filtered to determine whether the chirp should be discarded or kept, step 257, and if the chirp is kept, the system ID may be added (step 270) to the Distress List, step 280. The Distress List is constantly monitored to ensure that it contains members, determination 271. If the Distress List contains any members (i.e., determination 271="No"), the CoAN system begins or continues to sound its various alarms (including audible alarms), step 273. If the Distress List has no members (i.e., determination 271="Yes"), the alarm subsystem is set to quiet, step 272.

Implementation of the CoAN networking protocol requires fully secure channels for most messaging functions between the transmitting (TX) CoAN system and the receiving (RX) CoAN system. There are two exceptions to this rule. First, the initial messages that indicated Network Establishment (NE) are partially secured chirps. These messages progressively become more secure during the security encapsulation mode, step 260. Messages become fully secure chirps when the communication channel between the two CoAN systems is created. Second, distress chirps may be added to the Distress list, step 271, when received in an open channel. In this embodiment, the receiving CoAN system only requires open authentication.

The processing described above and illustrated in FIG. 5B and FIG. 5C may be executed each time a chirp is received until the CoAN system is deactivated. When the CoAN system is deactivated by a user, the system may transmit a network deactivation signal, such as a goodbye chirp, to each CoAN system with which a communication link has been established. In one embodiment, a goodbye chirp may be transmitted to each member of the system's cooperative alarm network via their respective secure communication links, while in another embodiment a goodbye chirp may also be transmitted to every other CoAN system that the deactivating system has joined via the respective communication links established by each of the other CoAN systems.

The processing described above and illustrated in FIG. 5B is one possible embodiment provided by way of example. The CoAN system may use any number of decision-making algorithms including table-lookups, threshold comparisons, pattern matching, etc. For example, the probability decision to add an open-channel distress chirp to the Distress List, step 257, may include decisions about gross proximity of the transmitting CoAN system. If a received distress chirp is transmitted by a CoAN system that is physically very close to the receiving CoAN system, its probability of addition to the Distress List is high. If the corporative alarm network is strongly consistent of secure-channel CoAN systems, then the probability of adding an open-channel distress chirp is low. Other methods for processing message signals known in the art may also be employed without departing from the spirit of the claims.

Figure 6:
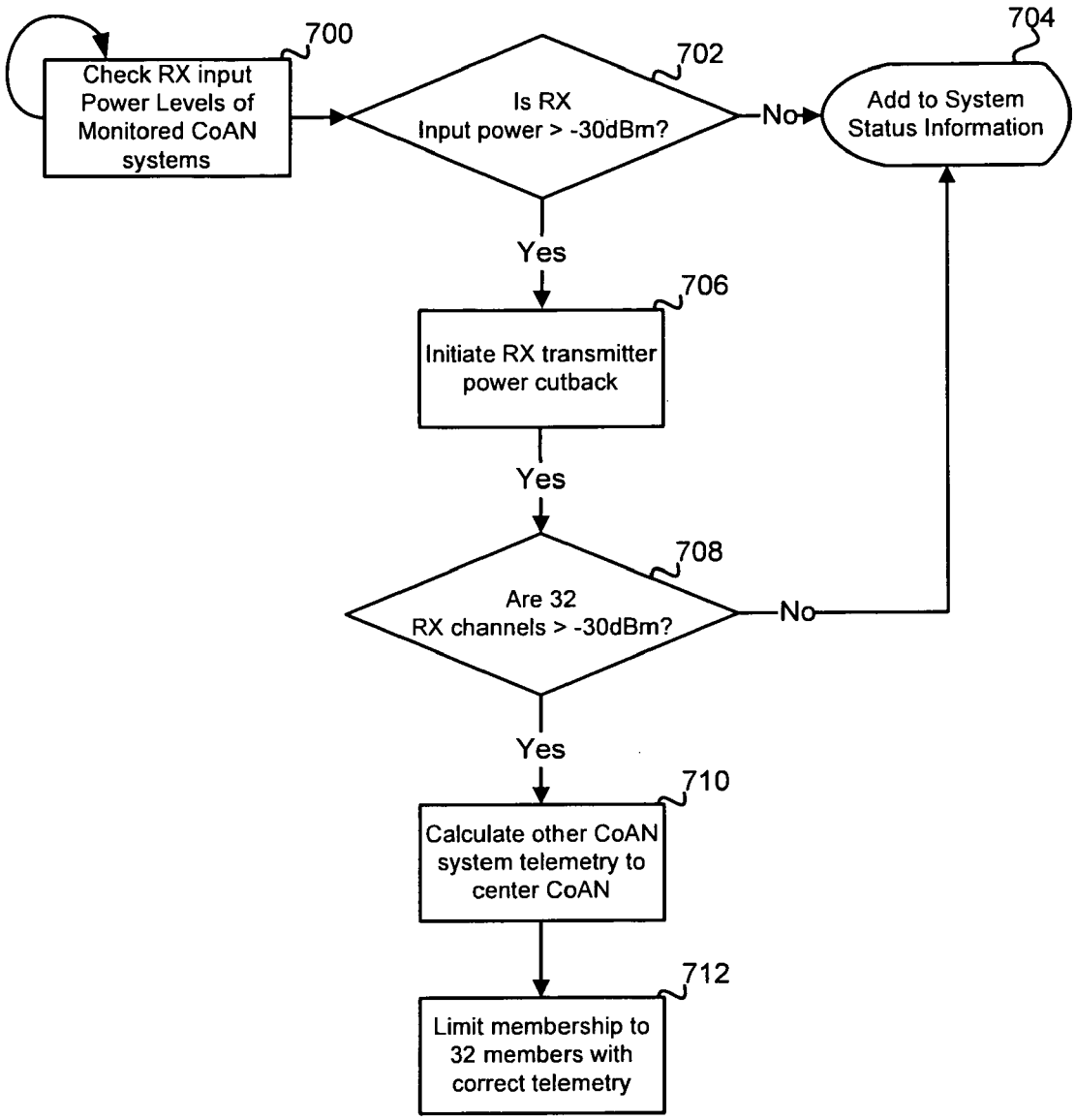
FIG. 6 is a process flow diagram of an embodiment method suitable for limiting a power level of messaging transmissions and limiting the number of cooperative alarm networks established.

As mentioned above, an alternative embodiment includes the capability to dynamically limit the number of CoAN systems within a cooperative alarm network to some maximum number (e.g., 32) that are closest to the CoAN system, which may be accomplished according to a method such as shown in FIG. 6. As mentioned in a later embodiment, the CoAN RX subsystem low noise amplifier, LNA (340 in FIG. 10), has low input sensitivity (e.g., −107 dBm) and wide dynamic range (e.g., 14 bits or ~84 dB). However, the LNA 340 can saturate (become inoperable) if the signal strengths of the RX channels are too high. To address this, the CoAN system may aggressively monitor the power levels of each RX channel, step 700. If the RX power of each channel exceeds some maximum (e.g., −30 dBm), determination 702, the center CoAN system may instruct the RX transmitter to cut transmit power in steps, such as steps of 6 dB, step 706. This instruction may be issued during the handshaking procedure. In the same embodiment, if thirty two (for example) or more receive (RX) channels exceed −30 dBm, the cooperative alarm network is determined to be super-strong. If the number of RX channels with received power greater than −30 dBm exceeds 32, for example, (i.e., determination 708="Yes"), the CoAN system may make telemetry computations on each RX channel to determine absolute horizontal distance to the center CoAN system, step 710. As part of this process step the CoAN system may calculate spatial position to ensure that cars on the same horizontal plane are included in the cooperative alarm network. The CoAN system then limits membership in this super-strong cooperative alarm network to some maximum number, e.g., thirty two. For example, in highly dense parking structures, such as parking garages, a CoAN system may form super-strong cooperative alarm networks because the proximities and density of autos is very high. In such cases, the CoAN systems may evaluate transmission power and telemetry data concurrently to select the most optimal subset of members as described above. This feature gives security personnel the opportunity to quickly locate cooperative alarm networks under threat.

As described above with reference to FIG. 6, CoAN systems may use a number of methods and algorithms to control the memberships of cooperative alarm networks. This feature is essential to maintaining maximal performance of each CoAN system.

As described earlier with reference to FIG. 5B, each CoAN system can respond to Distress Chips in the open channel chirp formulation. In such cases, the transmitting and receiving CoAN systems may not have established a secure intercommunication channel as is usually required for the CoAN protocol. The open chirp formulation uses codes and algorithms embedded in CoAN chipsets to ensure high-single sided secure transmission between CoAN systems.

Figure 7:
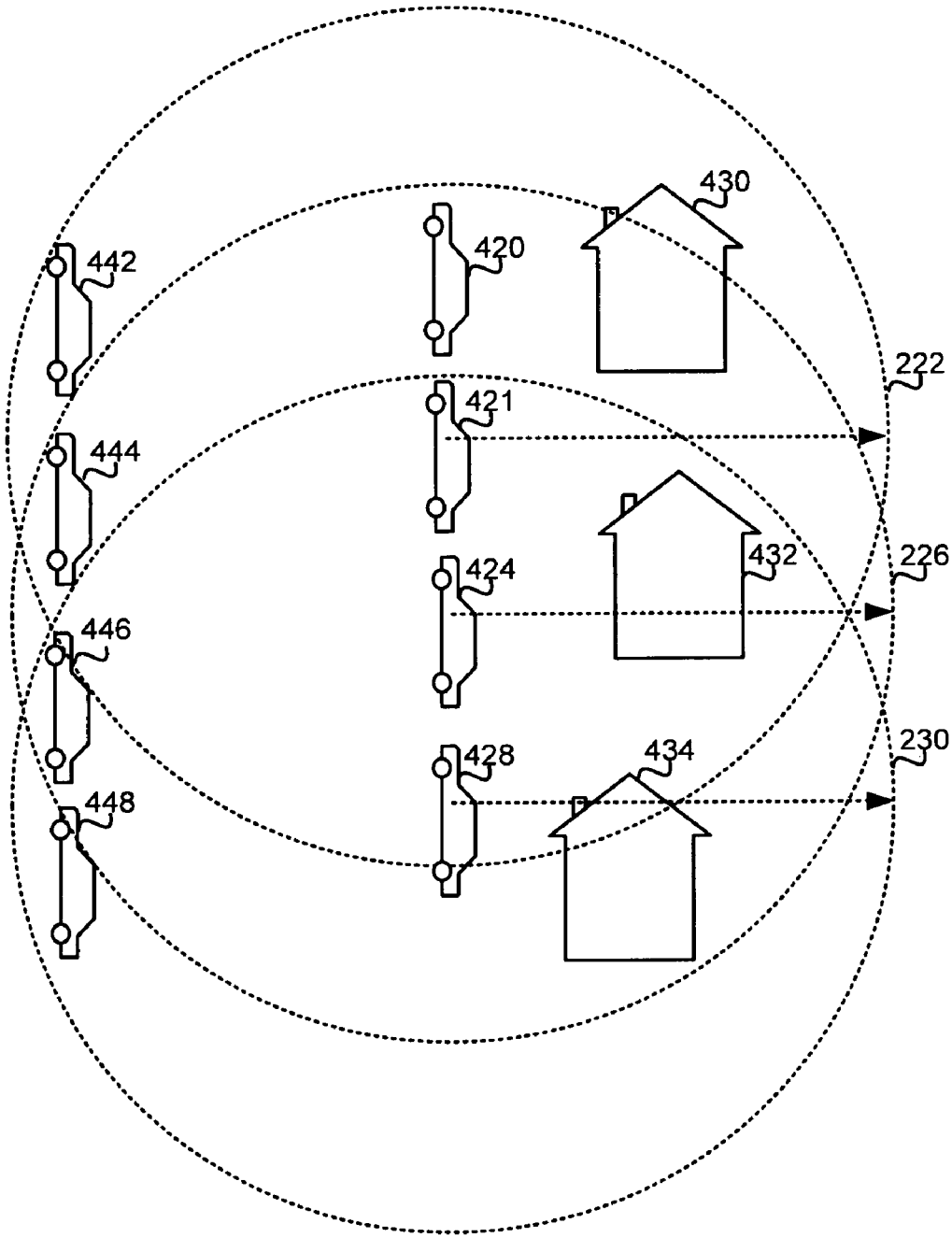
FIG. 7 is a system block diagram of cooperative alarm networks in a typical deployment.

The previously discussed embodiments have focused on car alarms. However, the functionality of cooperative alarm networks can also be implemented in a house alarm system. The intrusion sensors and security measures common in home alarms are well known in the art, and can be combined into a CoAN system for the house. The CoAN signaling protocol is exactly as described for autos. Autos and homes can participate in cooperative networks. In such an embodiment, the cooperative alarm network of a car could include one or more houses and vice versa. As with cooperative alarm networks including only cars, car-house cooperative alarm networks can overlap. This is illustrated in FIG. 7. In this example, a cooperative alarm network 222 centered on car 421 includes CoAN systems in two houses 430, 432, as well as in five other cars 420, 424, 428, 442 and 444. In the case of a security event within car 421, the other CoAN systems in each of the other five cars 420, 424, 428, 442, 444 and two houses 430, 432 that are members of the cooperative alarm network 222 can take security measures such as sounding sirens, honking horns and flashing lights. Similarly, cooperative alarm networks 226 and 230 are centered on cars 424 and 428, respectively.

Figure 8:
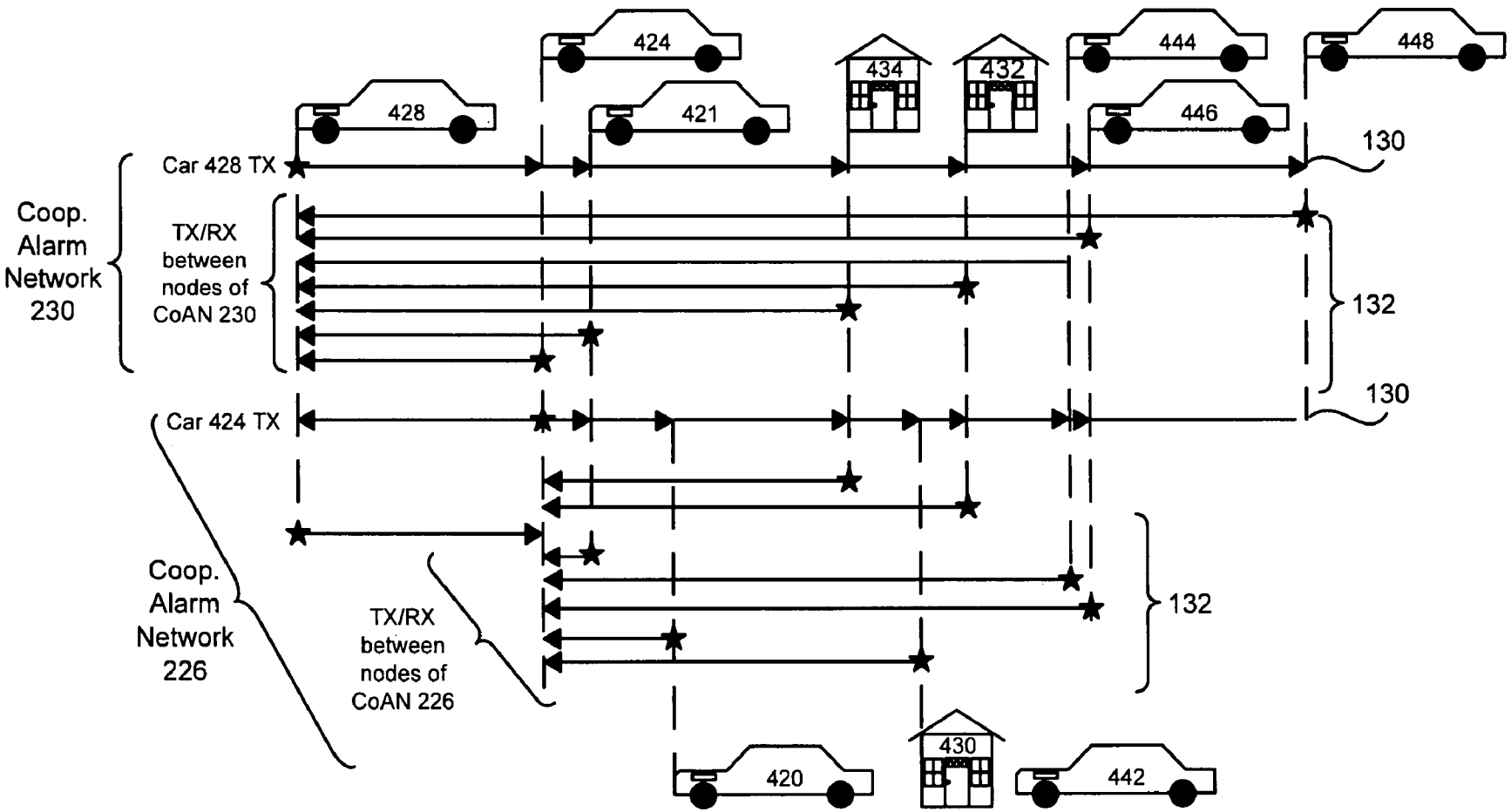
FIG. 8 is a message flow diagram of various messages transmitted among various participating nodes in the cooperative alarm networks illustrated in FIG. 9.

To illustrate the signaling involved in the cooperative alarm networks illustrated in FIG. 7, FIG. 8 shows a flattened view of just two (of eleven) of the cooperative alarm networks. In this example, there are 11 nodes and 11 cooperative alarm networks possible. For illustrative purposes, consider car 428 with cooperative alarm network 230. This car 428 initially transmits network establishment chirps 130 to all nodes in its detection range 434, 432, 424, 421, 446, 448. To complete the cooperative alarm network 230, each node creates a secure communications channel 132 between itself and the CoAN system on which the cooperative alarm network is centered 428. Similarly, to complete cooperative alarm network 226 centered on car 424, each node 434, 432, 430, 428, 421, 420, 444, 446 forms a secure channel between itself and the central CoAN system 424 as shown. FIG. 8 is shown for illustrative purposes only. In actual implementation, there is no limit on how the cooperative area networks overlap or intersect.

Figure 9:
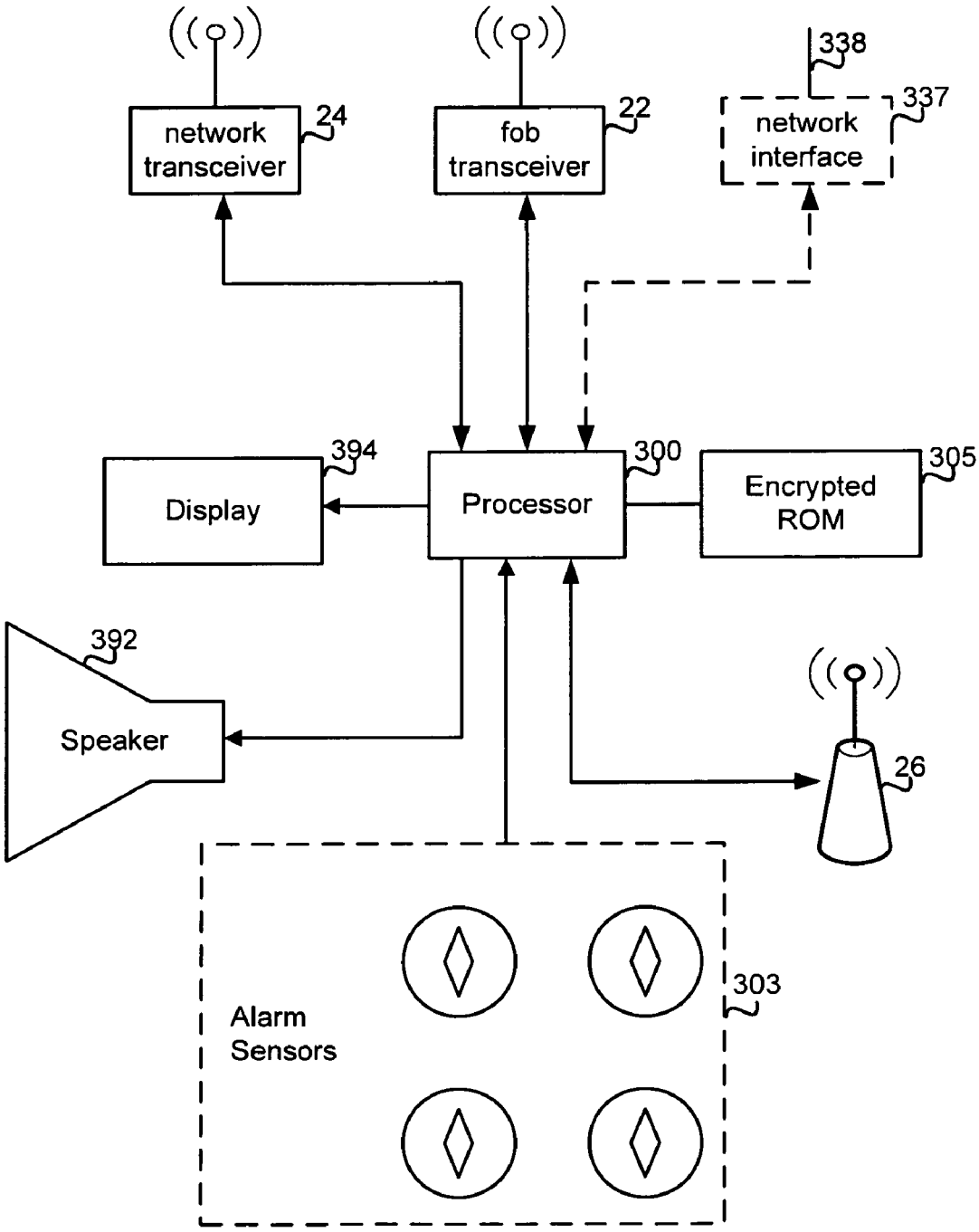
FIG. 9 is a circuit block diagram of an example electronic device suitable for use with the various embodiments.

The embodiments described above may be implemented on any of a variety of electronic and computing devices, including the example embodiment illustrated in FIG. 9. The alarm system may include a processor 300, such as a microprocessor, microcomputer or programmable digital signal processor, which performs most of the logic required to implement a CoAN system. An encrypted read-only memory (ROM) 305 may store unique CoAN ciphers and other proprietary CoAN protocol constants that the processor 300 uses to generate unique CoAN IDs, etc. Alarm sensors 303 provide signals to the main processor 300 to enable the processor to determine when a security event is occurring. One or more signals from the alarm sensors 303 may also be used in generating the unique identifier as described above. A display 394 may be coupled to the processor 300 to present status and user option displays. A speaker 392 may be coupled to the processor 300 to create an audible siren as part of security measures when a security event is detected. The processor 300 may also be coupled to the car's electrical system to enable it to flash headlights to create a visual display during a security event. A wired or wireless network interface transceiver 26 may be coupled to the processor 300 to enable the alarm system to communicate with various external wired or wireless networks using cellular and/or wireless LAN protocols (e.g., IEEE 802.11). A wireless control transceiver 22 may be coupled to the processor 300 to enable the alarm to communicate with a control key fob 29. A wireless cooperative network transceiver 24 may be coupled to the processor 300 to send and receive network signaling chirps. Additionally, an optional wired cooperative network transceiver 337 may be coupled to the processor 300 to enable the system to send and receive network signaling chirps via wired networks 338. As would be appreciated by one of skill in the art, the wireless control transceiver 22 and the wireless cooperative network transceiver 24 may be the same unit (i.e., a transceiver that can communicate both with key fobs and with other CoAN systems). Similarly, the optional wired cooperative network transceiver 337 may be configured to receive control signals for controlling the CoAN system. Also, the wireless control transceiver 22 and the wireless cooperative network transceiver 24 may include a processor, such as a DSP, and memory.

Figure 10:
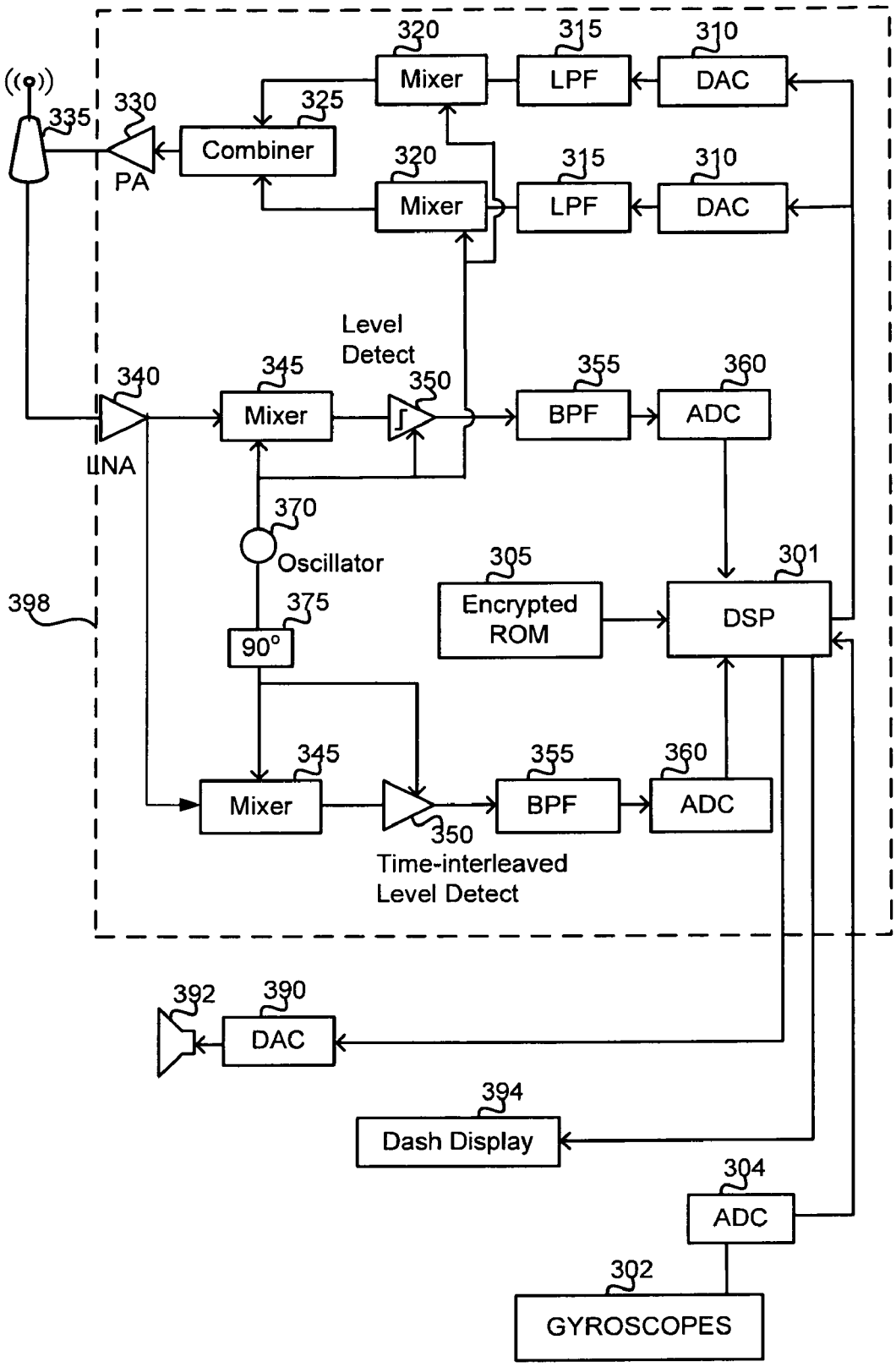
FIG. 10 is a circuit block diagram of another example electronic device suitable for use with the various embodiments.

Another embodiment of the CoAN system is illustrated in FIG. 10. This system implements a high reliability Incident/Quadrature (I/Q) direct-to-baseband receive and an I/Q upconverter, together 398. The alarm system may be centered on a main digital signal processor (DSP) 301. An encrypted ROM 305 may be coupled to the DSP 301 to store unique system ciphers and CoAN protocol constants that can be used by the DSP 301 to generate a unique identifier. The main DSP 301 may be coupled to a dash display 394 to display the status of the alarm as well as user option menus. The DSP 301 may be coupled to a siren 392 via a digital-to-analog converter 390 which converts digital signals to analog signals required to drive the siren 392. The DSP 301 may detect intrusions through a series of wheel-well mounted gyroscopes 302 connected to an analog to digital converter 304.

The DSP 301 can transmit network signaling chirps via a transmitter comprising a series of components including digital-to-analog converters 310, low pass filters 315, a power amplifier (PA) 330, and an antenna 335. The circuitry to transmit network signaling chirps may also include signal mixers 320 and oscillator 370 for spread-spectrum modulation and up-conversion. The network signaling chirp circuitry may also include a combiner 325 to sum the I/Q modulated signal power for transmission. An embodiment transmits a spread spectrum signal by switching frequencies (frequency hopping) between 79 frequency bins spaced 1.0 MHz within the ISM 2.4 GHz band (2.4 GHz to 2.4835 GHz) extremely rapidly. Unlike other wireless standards, CoAN channels are composed of data transmitted on all 79, or a subset, of frequency bins. The frequency bins for transmission are determined during handshaking between two CoAN systems. The CoAN systems select the most optimal subset of frequency bins to form channels with the highest throughput. This random frequency switching rate of 6400 times per second corresponds to a time-slot of 156.25 μs. However, different transmission bands and transmission methods may be used without departing from the spirit of the invention.

The DSP 301 may receive network signaling chirps via a direct-to-baseband signal chain comprising an antenna 335, a low noise amplifier (LNA) 340 with wide input dynamic range, mixers 345, level detect circuits 350, band pass filters 355 and an analog-to-digital converter 360. The oscillator 370 performs frequency translation and the peak detector computes receive power in time interleaved mode. In an embodiment, the receiver circuit elements down-convert the received RF signals from up to 256 unique nodes without saturating the head-end. In an embodiment, the input sensitivity for the head-end is −107 dBm for a bit error rate (BER) of $10^{-6}$. The LNA has a dynamic range of 84 dB (14 bits). However, the system may only discriminate and rank 128 (or some other maximum number of) unique CoAN systems.

In a preferred embodiment, transmitting and receiving circuits include a direct-to-baseband receive and transmit I/Q system that uses QPSK (Quadrature-Phase-Shift-Keying) spread-spectrum modulation to differentiate from the FSK (Frequency-Shift-Keying) used in Bluetooth systems. The spread spectrum implementation hardens the CoAN system against jamming, crosstalk and other interference.

The foregoing method descriptions and the process flow diagrams are provided merely as illustrative examples and are not intended to require or imply that the steps of the various embodiments must be performed in the order presented. As will be appreciated by one of skill in the art, the order of steps in the foregoing embodiments may be performed in any order.

The hardware used to implement the foregoing embodiments may be processing elements and memory elements configured to execute a set of instructions, including microprocessor units, microcomputer units, programmable floating point gate arrays (FPGA), and application specific integrated circuits (ASIC/RFIC) as would be appreciated by one of skill in the art, wherein the set of instructions are for performing method steps corresponding to the above methods. Alternatively, some steps or methods may be performed by circuitry that is specific to a given function.

Those of skill in the art would appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The steps of a method or algorithm described in connection with the embodiments disclosed herein may be embodied directly in hardware, in a software module executed by a processor, or in a combination of the two. A software module may reside in processor readable memory which may be any of RAM memory, flash memory, ROM memory, EPROM memory, EEPROM memory, flash media, registers, hard disk, solid state drive (SSD), a removable disk, e.g., an optical CD-RW or DVD-RW disk, or any other form of storage medium known in the art. An exemplary storage medium is coupled to a processor such that the processor can read information from, and write information to, the storage medium. In the alternative, the storage medium may be integral to the processor. The processor and the storage medium may reside in an ASIC. The ASIC may reside in a user terminal or mobile device. In the alternative, the processor and the storage medium may reside as discrete components in a user terminal or mobile device. Additionally, in some aspects, the steps and/or actions of a method or algorithm may reside as one or any combination or set of codes and/or instructions on a machine readable medium and/or computer readable medium, which may be incorporated into a computer program product.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

We claim:

1. An alarm system, comprising:

a processor;

a sensor coupled to the processor, the sensor configured to detect a security event;

a wireless or wired transceiver coupled to the processor; and an annunciator coupled to the processor;

wherein the processor is configured with executable instructions to perform steps comprising:

generating a session-unique system identifier for the alarm system;

broadcasting announce and network establishment chirps which includes a unique identifier and other security information;

receiving a cooperative network establishment message from nearby alarm systems, the cooperative network establishment chirp including a system identifier of the nearby alarm system;

establishing a first secure communication channel with the nearby alarm systems;

monitoring an alarm sensor to detect a security event;

transmitting via the first communication channel an OK status message so long as a security event is not detected;

transmitting via the first communication channel a security event message when a security event is detected;

receiving a network establishment message from a nearby alarm system;

transmitting a cooperative network establishment message in response to receiving the network establishment message from the nearby alarm system;

forming a second secure communications channel with nearby alarm systems;

receiving via the second secure communication channel a security event message from the nearby alarm system; and activating the annunciator in response to receiving the security event message via from the nearby alarm system.

2. The alarm system of claim 1, wherein the processor is a digital signal processor.

3. The alarm system of claim 1, wherein the wired or wireless transceiver is configured to generate a spread spectrum signal by extremely fast random frequency switching between 79, or fewer, frequency bins spaced 1.0 MHz within the frequency range of approximately 2.4 GHz to approximately 2.4835 GHz.

4. The alarm system of claim 3, wherein the wired or wireless transceiver is configured to receive messages transmitted in a spread spectrum signal.

5. The alarm system of claim 1, wherein the wired or wireless transceiver is configured to transmit signals at approximately 20 dBm, thereby limiting the effective detection radius to approximately 100 meters.

6. The alarm system of claim 1, wherein the session-unique identifier for the alarm system is generated based upon an alarm sensor value and a unique cipher key stored in the alarm system.

7. The alarm system of claim 1, wherein the processor is configured with executable instructions to perform further steps comprising:

transmitting via the first communication channel a security event resolution message when the security event is resolved;

receiving via the second communication channel a security event resolution message from the nearby alarm system; and deactivating the annunciator in response to receiving a security event resolution message via the second communication channel from the nearby alarm system.

8. The alarm system of claim 1, wherein the processor is configured with executable instructions to perform further steps comprising transmitting and receiving via the first and second communication channel a network deactivation message when the respective alarm systems are deactivated.

9. The alarm system of claim 1, wherein the processor is configured with executable instructions to perform further steps comprising encrypting the transmit channel and encoding OK status and security event messages using the session-unique identifier as an encryption key.

10. The alarm system of claim 1, wherein the processor is configured with executable instructions to perform further steps comprising decrypting the received channel and decoding security event messages using the session-unique identifier received from the nearby alarm system as an encryption key.

11. The alarm system of claim 1, wherein the processor is configured with executable instructions to perform further steps comprising:

receiving cooperative network establishment chirps from a plurality of nearby alarm systems; and establishing communication channels with a subset of the plurality of nearby alarm systems based upon signal strengths and telemetry of the received cooperative network establishment chirps.

12. The alarm system of claim 1, wherein the processor is configured with executable instructions to perform further steps comprising:

receiving cooperative network establishment chirps from a plurality of nearby alarm systems;

establishing communication channels with the plurality of nearby alarm systems, and initiating decreasing transmission power of the nearby wired or wireless transceivers in order to limit the plurality of nearby alarm systems with which communication channels are established to within a maximum number.

13. A cooperative alarm system, comprising:

a processor;

a sensor coupled to the processor, the sensor configured to detect a security event;

a wireless or wired transceiver coupled to the processor; and an annunciator coupled to the processor;

wherein the processor is configured with executable instructions to perform steps comprising:

transmitting a first type of network signaling announce chirp via the wireless or wired transceiver, the first type of network signaling chirp for network establishment;

using a second type of network signaling chirps to form secure communications channels with another alarm system;

transmitting alarm system OK chirps indicating no security event is detected;

monitoring the sensor to detect a security event;

transmitting alarm system distress chirps via the wireless or wired transceiver if a security event is detected, the alarm system distress chirps indicating that the security event is detected;

receiving alarm system distress chirps via the transceiver from the other alarm system; and activating the annunciator in response to receiving alarm system distress chirps from the other alarm system.

14. The alarm system of claim 13, wherein the processor is configured with executable instructions to perform further steps comprising:

measuring a signal strength of the received second type of network signaling chirp; and determining whether to signal the other alarm system to reduce broadcast power.

15. The alarm system of claim 13, wherein the processor is configured with executable instructions to perform further steps comprising:

measuring a signal strength of received network signaling chirps received from a number of other alarm systems;

adjusting a threshold value based on the measured signal strengths of received network signaling chirps and the number of other alarm systems so that received network signaling chirps from a predetermined number of the other alarm systems is below the threshold value.

16. The alarm system of claim 13, wherein the processor is configured with executable instructions to perform further steps comprising transmitting a third type of network signaling chirp indicating that the alarm system is being deactivated.

17. The alarm system of claim 13, wherein the processor is configured with executable instructions to perform further steps comprising:

generating an identifier that is unique to the alarm system;

including the identifier within transmitted first and second types of network signaling chirps; and recognizing identifiers of other alarm systems included in received first and second types of network signaling chirps.

18. The alarm system of claim 17, further comprising a memory having stored therein a value unique to the alarm system, wherein the processor is configured with executable instructions to perform further steps comprising:

receiving a value from the sensor; and generating the unique identifier based upon a combination of the value received from the sensor and the value unique to the alarm system stored in the memory.

19. A method for establishing a cooperative alarm network, comprising:

transmitting a first type of network signaling chirp from a first alarm system, the first type of network signaling chirp indicating that no security event is detected;

monitoring a sensor coupled to the first alarm system to detect a security event;

transmitting a second type of network signaling chirp from the first alarm system if an security event it detected, the second type of network signaling chirp indicating that the security event is detected;

receiving at the first alarm system the second type of network signaling chirp from a second alarm system; and activating security measures at the first alarm system in response to receiving the second type of network signaling chirp from the second alarm system.

20. The method of claim 19, further comprising:

broadcasting from the first alarm system a network establishment signal;

receiving at the first alarm system a plurality of cooperative network establishment signals from a plurality of nearby alarm systems; and establishing communication channels between the first alarm system and each of the plurality of nearby alarm systems, wherein the first and second type of network signaling chirps are transmitted via the established communication links.

21. The method of claim 20, further comprising:

measuring at the first alarm system a signal strength of the received cooperative network establishment signals; and adjusting a threshold value at the first alarm system based on the measured signal strengths of received plurality of cooperative network establishment signals so that no more than a predetermined number of received cooperative network establishment signals exceed the threshold value, wherein establishing communication channels between the first alarm system and each of the plurality of nearby alarm systems comprises establishing communication channels between the first alarm system and each of the plurality of nearby alarm systems whose plurality of cooperative network establishment signals exhibit a signal strength exceeding the threshold value.

22. The method of claim 20, further comprising:

adjusting a transmission power so that the received plurality of cooperative network establishment signals does not exceed a maximum number.

23. The method of claim 19, further comprising transmitting a fourth type of network signaling chirp indicating that the first alarm system is being deactivated.

24. The method of claim 19, further comprising:

generating an identifier that is unique to the first alarm system;

including the identifier within the first and second types of network signaling chirps; and recognizing identifiers of the second alarm system in received first and second types of network signaling chirps.

25. The method of claim 19, wherein generating the identifier for the first alarm system comprises:

receiving a value from a sensor; and generating the identifier based upon a combination of the value received from the sensor and a value stored in memory of the first alarm system.

* * * * *